United States Patent [19]

Kjose

[11] 4,182,391

[45] Jan. 8, 1980

[54] COMBINED GOLF BAG AND EQUIPMENT CARRIER

[76] Inventor: Kenneth L. Kjose, 1306 N. Columbus Ave., Apt. #312, Glendale, Calif. 91202

[21] Appl. No.: 909,206

[22] Filed: May 25, 1978

[51] Int. Cl.[2] ..... A63B 55/00

[52] U.S. Cl. ..... 150/1.5 R; 150/52 R

[58] Field of Search ..... 150/1.5 R, 1.5 B, 1.5 C, 150/52 R

[56] References Cited

U.S. PATENT DOCUMENTS

| | | | |
|---|---|---|---|
| 1,597,870 | 8/1926 | Reach | 150/1.5 R |
| 1,636,194 | 7/1927 | Mullins | 150/1.5 R |
| 1,637,538 | 8/1927 | Sampson | 150/1.5 R |
| 1,920,308 | 8/1933 | Hiles | 150/1.5 R |
| 2,010,166 | 8/1935 | Thompson | 150/1.5 R |
| 2,023,792 | 12/1935 | Sampson | 150/1.5 R |
| 3,530,919 | 9/1970 | May | 150/1.5 R |

*Primary Examiner*—Ro E. Hart

*Attorney, Agent, or Firm*—Roger A. Marrs

[57] ABSTRACT

A combined golf bag and game equipment carrier is disclosed herein having a pair of elongated sections attached together by a common central strip and incorporating a zippered closure extending about the adjacent edges of the sections from one end of the strip to its opposite end whereby the sections may be readily opened or closed with respect to each other. Each section is box-like and is provided with internal and external pockets as well as tubular enclosures for storage of equipment and clothing useful in the playing of a game of golf. The sections are reversible when folded over upon themselves along hinge lines at their integral junction with the central strip so as to provide a first position serving as a golf bag carrier and a second position serving as an equipment carrier. Strap and handle means are provided for their respective positions.

6 Claims, 7 Drawing Figures

COMBINED GOLF BAG AND EQUIPMENT CARRIER

BACKGROUND OF THE INVENTION

1. Field of the Invention

This invention relates to sporting equipment and more particularly, to a novel golf bag and golf equipment carrier formed into a single unitary case or construction including provisions for accommodating a variety of playing equipment and accessories normally employed in the game of golf. The present invention will be described in connection with accessories normally employed in the game of golf, but it is to be understood that this is by way of illustration and not of limitation.

2. Description of the Prior Art

In the playing of the game of golf or the like, it has been the customary practice to design, manufacture and sell separate and independently constructed equipment accessories for the purpose of storing golf clubs, cases for hauling the golf clubs from place to place, holders for golf balls, tees, etc. Each accessory such as a golf bag or a golf carrier is sold as an independent unit and consequently, it is normally necessary to have a multiplicity and plurality of separate such accessories in order to accommodate the various equipment required in the playing of golf. Each of such an accessory is expensive so that the accumulation of several carriers, bags, carts or the like is quite costly and the number of accessories requires substantial storage space when not in use.

Therefore, a long standing need has existed to provide a single or unitary construction serving as a combined golf bag and golf equipment carrier which is convenient to use and which may be readily converted from its use as a golf equipment carrier to that of a golf bag and vice versa with ease.

SUMMARY OF THE INVENTION

In accordance with the present invention, all of the above applications and many others are achieved through the employment of the present invention which is readily and quickly available for use for any one of a variety of accessory uses which are normally attributable to the use of separate and independent accessories and equipments. The problems and difficulties encountered by the use of conventional golf equipment storage and carrying devices are obviated by the present invention which provides a unitary case having a pair of box-like sections capable of being folded into one of two positions so that a central cavity is defined in either of the positions. A common central strip is provided serving as one side of each of the box-like sections and forms a hinge line therewith to accommodate the folding procedure. A zippered closure extends from one end of the central strip to the opposite end along the adjacent edges of the sections which when closed secures the opposing edges of the box-like sections together in either of the two aforementioned positions. Pocket and enclosure means are provided on the sections for receiving and storing a variety of equipment such as golf clubs, golf balls, tees, clothing and the like. Strap means are provided for personal handling of the device in either its position as a golf bag or as a golf equipment carrier.

Therefore, it is among the primary objects of the present invention to provide a unitary carrier and bag for golf equipment and accessories incorporating integrally formed pockets and portions adapted to receive a variety of golf equipment for storage and for hauling purposes.

Another object of the present invention is to provide a novel combined golf bag and golf equipment carrying device which is of unitary construction and which is of reversible character so that portions may be folded over upon themselves for conversion from a golf carrier to a golf bag.

Another object of the present invention is to provide a novel integrally formed body construction or case comprising a combined golf bag and golf equipment carrier selectively and reversibly adapted to provide a variety of functions and purposes associated with the normal requirements and usage of persons engaging in the game of golf such that the body construction may be converted for several uses without the removal of parts or the adding of additional parts to make up an independent usage.

Still a further object of the present invention is to provide a novel monolithic golf bag and golf equipment carrier apparatus having integrally formed parts and elements adapted to combine a plurality of normal uses into a single article normally requiring a plurality of articles for separate usage.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
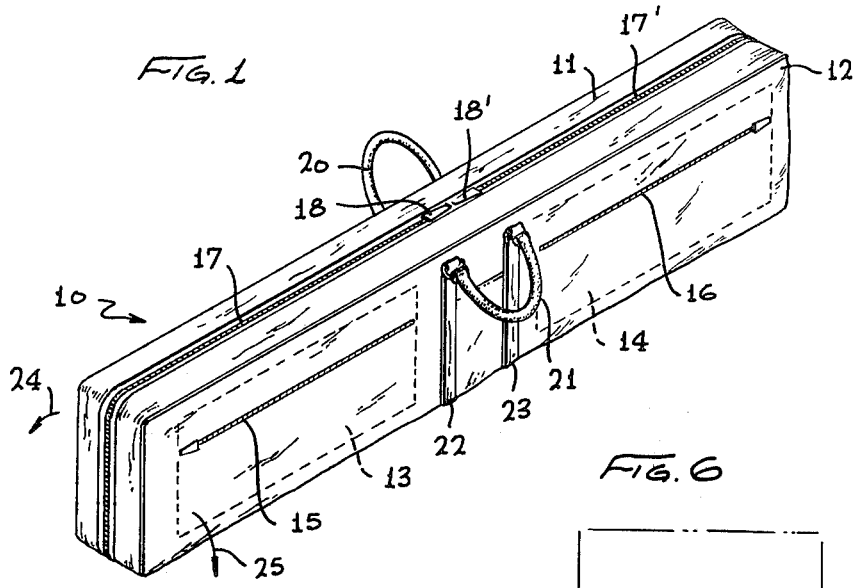
FIG. 1 is a perspective view showing the apparatus of the present invention in its position as an equipment carrier.

Referring to FIG. 1, the novel combined golf bag and equipment carrier is illustrated in the general direction of arrow 10 which comprises, in general, an elongated body or case construction having a pair of box-like sections 11 and 12. Each of the sections includes a pair of pockets 13 and 14 which are zippered along the closure means 15 and 16 which provides selective access to the interior of the pockets. Clothing, pads, pencils and other game supplies may be kept in these pockets. Also, it should be noted that the box-like sections 11 and 12 are joined together along their opposing edges by a closure means 17 consisting of opposing toothed edges which are joined by a closure 18 which is slidably engaged with the toothed edges. It is further to be noted that a pair of zippered closures, indicated by numerals 17 and 17' are employed so that the respective sliding closure of each zipper construction terminates mid way along the zippered track between the opposite ends of the box-like sections. By this means, the left hand side of the apparatus may be opened by sliding the zipper closure 18 along the toothed track 17 while the right side of the apparatus may be opened by sliding the closure 18' along the closure track 17'.

For convenience in carrying, a pair of handles 20 and 21 are provided so that the user may carry the device from one place to another. It is to be particularly noted that the handles are located substantially in the center of the apparatus so that the weighted equipment is balanced and that a pair of supporting straps 22 and 23 are located around the sides of each box-like section and around the bottom thereof so as to adequately support the load of the equipment.

In the configuration shown in FIG. 1, the apparatus serves as an equipment carrier with not only the external pockets available for storage but the internal cavity of the apparatus being loaded with equipment. When it is desired to change the apparatus or convert the apparatus from an equipment carrier to a golf bag, the zippers 18 and 18' are opened by sliding the closures to the left and right as previously described so that the box-like sections 11 and 12 may be pivoted away from one another as indicated by the arrows 24 and 25 respectively.

Figure 2:
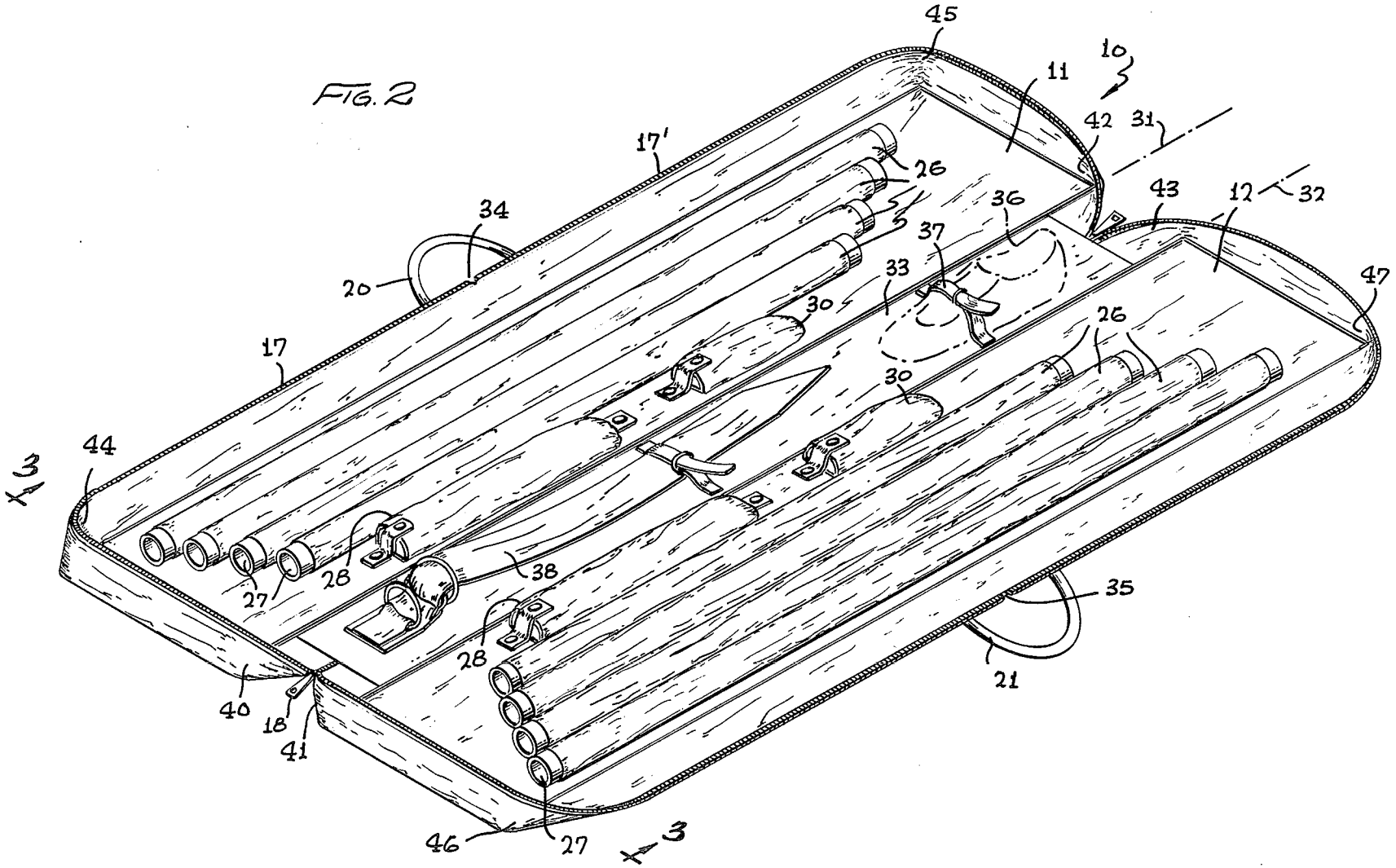
FIG. 2 is a perspective view showing the apparatus of FIG. 1 opened for access to equipment stored therein and representing an intermediate position between the equipment carrier position and the golf bag position.

Referring now in detail to FIG. 2, it can be seen that the box-like sections 11 and 12 are fully opened and are in an intermediate position which is substantially flat so as to expose the equipment stored therein. For storing purposes of golf clubs, a plurality of tubular members such as represented by numeral 26 are provided which are intended tubular sleeves 27 so that the handle of a golf club may be inserted therein. Preferably, these tubes and sleeves are of a tapered nature indicating the direction in which the handle is to be initially inserted into the respective tubes. Although any number of clubs may be carried in the apparatus of the invention, nine sleeves are provided for a minimum number of clubs which is illustrative of the present invention. Also, small pockets are provided for other equipment such as pocket 28 may be provided for storing golf balls while pocket 30 may be employed for storing golf tees.

It is to be further noticed in FIG. 2 that the box-like sections 11 and 12 rotate about a longitudinal axis 31 and 32 respectively which are integrally related with a central strip indicated by numeral 33. The opposite ends of the strip 33 terminate substantially short of the overall length of each of the box-like sections and the zippered track 17 and 17' terminate at the end of the central strip 33. As previously mentioned, the other end of the zippered or toothed track terminates mid-way between the opposite ends of the box-like sections and is illustrated in FIG. 2 by the numerals 34 and 35. The central strip 33 may be employed for storing a pair of golf shoes 36 by means of a strap 37 and an elongated shoulder strap 38 has its opposite ends secured to the strip 33 which will be described further in reference to FIG. 5.

It is to be particularly noted in FIG. 2 that intermediate position represented thereby between the equipment carrier and the golf bag positions require that the box-like sections 11 and 12 be reversed. Therefore, it is to be understood that the composition of the box-like sections are pliable, flexible and readily reversible so that the sidewalls and endwalls of the box-like sections can be turned over or folded upon themselves so as to be reversed. As can be seen in FIG. 2, the adjacent corners 40, 41, 42 and 43 are somewhat crushed or stretched out whereas the outer corners 44, 45, 46 and 47 are relatively upright and unstretched. In other words, as the sections are rotated outwardly about the hinge lines 31 and 32, the inner corners 40, 41, 42 and 43 are pulled outwardly from the termination of the zipper at the opposite ends of central strip 33. It is for this reason that the added material of the box-like sections are longer in length than the length of the central strip.

Figure 3:
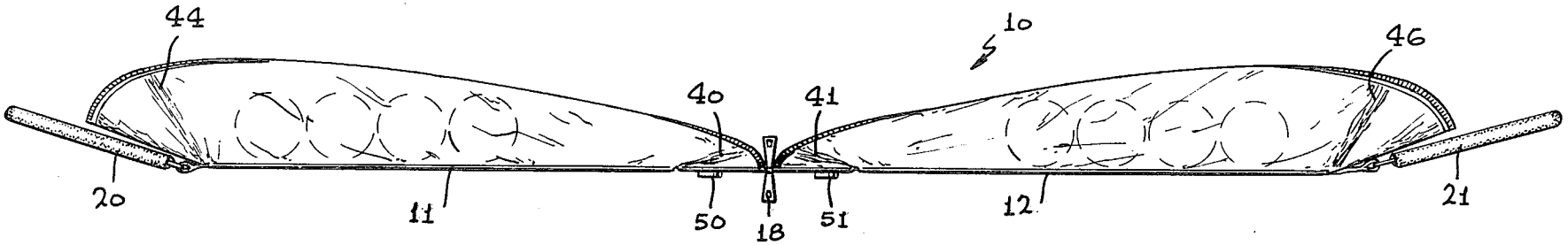
FIG. 3 is a transverse cross sectional view of the apparatus in its intermediate position as shown in the direction of arrows 3—3 of FIG. 2.

In FIG. 3, the intermediate position of the apparatus is illustrated and it can be seen that standoffs 50 and 51 are provided on the underside of the central strip 33. Also, the stretched and flattened appearance of the corners 40 and 41 are further illustrated.

Figure 4B:
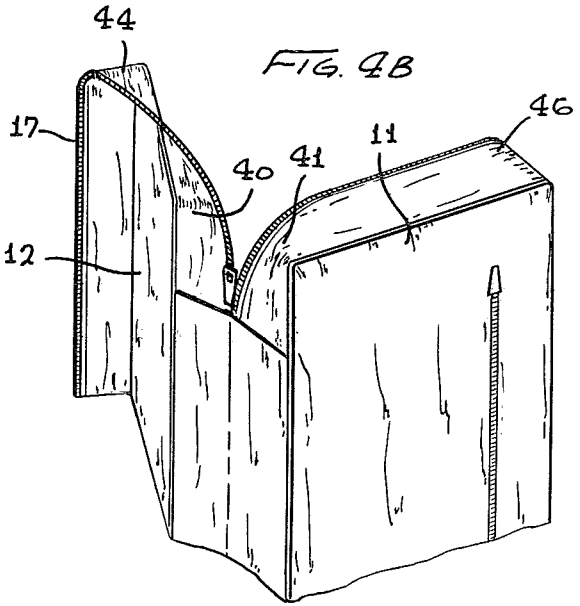
FIGS. 4A and 4B illustrate the folding over procedure for reversing the box-like sections converting the apparatus from the intermediate position shown in FIG. 2 to the golf bag position shown in FIG. 5.
Figure 4A:
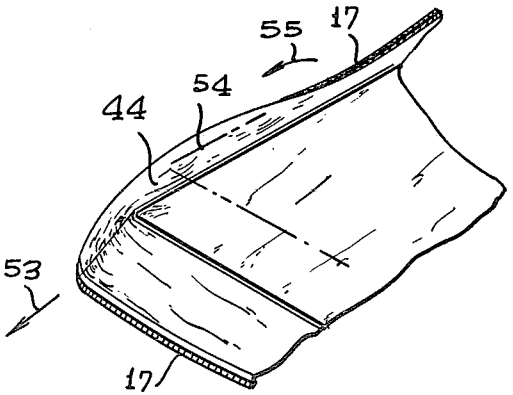

Referring now to FIGS. 4A and 4B, diagrammatic illustrations are provided showing the reversing of a corner so as to convert the bag from one position to the other. In FIG. 4A, corner 44 is illustrated in which thumb or finger pressure is exerted in the direction of arrows 53 so as to deform the material inwardly from the position shown in solid line. The dotted line position indicated by numeral 54 represents the pulling of the zipper line 17 over to the new position with the solid line position of the material ending up behind. The zipper is pulled in the direction of arrow 55 while the material is pushed in the direction of arrow 53. In FIG. 4B, the corner 44 is illustrated preparatory to being flipped or folded or reversed while the corner 40 has been so reversed. The corners 41 and 46 are in their original position as shown in FIG. 2 awaiting to be reversed using the process shown in FIG. 4A and as previously described with respect to corners 44 and 40 in FIG. 4B.

Figure 5:
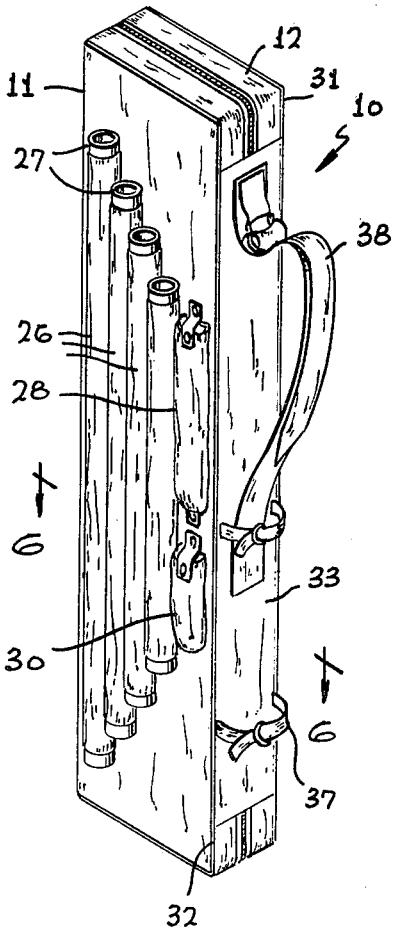
FIG. 5 is a perspective view of the apparatus illustrated in its position as a golf bag having the previously internally stored equipment exposed externally for use.

Referring now to FIG. 5, the apparatus of the present invention has progressed through the intermediate position shown in FIG. 2 into the golf bag position. In this latter position, the box-like sections 11 and 12 have been totally reversed so that the equipment which was previously stored on the inside of the carrying case in FIG. 1 are now exposed externally for use. The strap 38 is a shoulder strap and may be worn on the shoulder of the user during the course of play of the game of golf. Once the box-like sections 11 and 12 have been reversed so that their corners have been folded over upon themselves while the zippered closure is opened, the zipper closure may then be closed by using the alternate pull tab on the closure. The inside of the box-like sections forms a storage cavity or chamber into which clothing or the like may be disposed.

Figure 6:
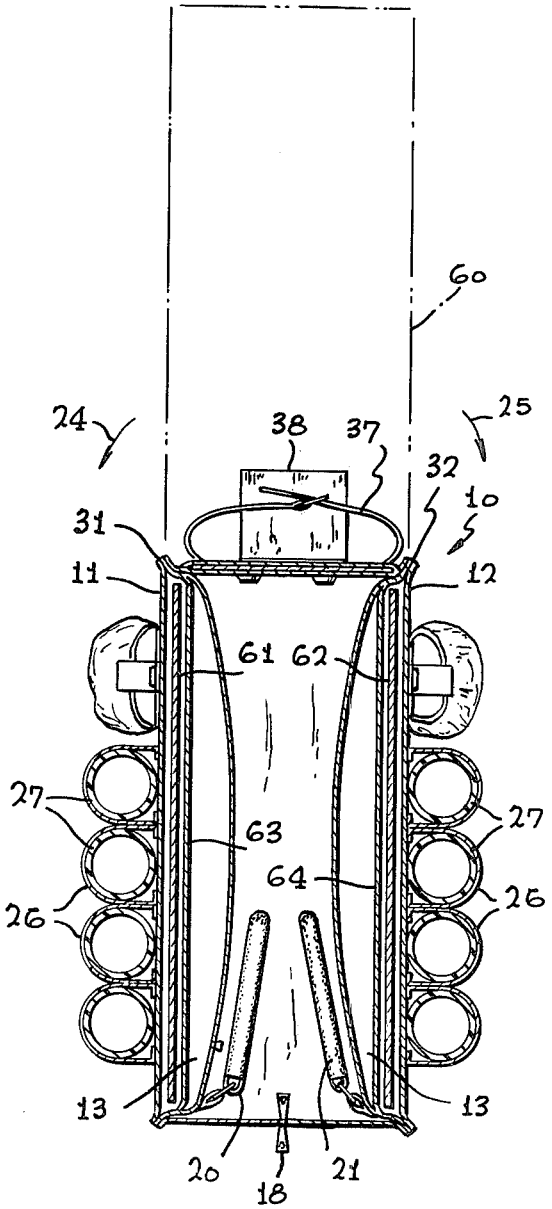
FIG. 6 is a transverse cross sectional view of the apparatus in its position as a golf bag as taken in the direction of arrows 6—6 of FIG. 5.

As shown in FIG. 6, the previously exposed pockets 13 and 14 associated with box-like section 12 are now internal and the golf club tubes and sleeves are external. To emphasize the convertible nature of the apparatus, FIG. 6 illustrates the apparatus in the equipment carrying position of FIG. 1 in dotted lines evidenced by numeral 60 and after unzipping of the closure means and folding over of the corners as well as pivoting the box-like sections on the pivots 31 and 32, the apparatus takes the form of the solid line position. Also, it can be seen that the device is stiffened by means of fiberglass stiffeners 61 and 62 lying immediately behind the fabric on which the tubes and sleeves are sewn. A fabric sheet 63 and 64 covers the stiffeners 61 and 62 respectively so that the stiffener is hidden from sight.

In view of the foregoing, it can be seen that the apparatus of the present invention provides a novel convertible apparatus suitable as an equipment carrying or transporting device and suitable upon folding and conversion to a golf bag equipment carrier.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A combined golf bag and equipment carrier comprising:

a monolithic body or case construction having an elongated central strip with box-like sections attached to opposite sides of said central strip;

closure means along the opposing edges of said box-like sections extending from one end of said central strip to its opposite end;

said body or case construction having a first and a second position defined by reversing each of said box-like sections over upon themselves to convert said construction into a golf bag as said first position and an equipment carrier as said second position; and carrying means carried on said central strip exposed externally for carrying said body or case construction when in its first position and handle means carried on said box-like sections adjacent a portion of said closure means for carrying said body or case construction in said second position;

said body or case construction is composed of a flexible and pliable composition adapted to permit the corners of said box-like sections to be pushed inside out to reverse said construction between said first and said second positions.

2. The invention as defined in claim 1 including:

hinge or fold lines established along a longitudinal axis on opposite sides of said central strip about which said box-like sections rotate as said construction is converted between said first and said second positions.

3. The invention as defined in claim 2 including:

a plurality of equipment storage pockets provided on a selected and co-extensive side of each of said box-like sections adapted to be exposed externally when said body or case construction is in said first position and internally disposed when in said second position.

4. The invention as defined in claim 3 wherein:

said carrying means is an elongated, flexible strap adapted to support said body or case construction in said first position from the shoulder of the user.

5. The invention as defined in claim 4 wherein:

said closure means includes a pair of zippers extending from said opposite ends of said central strip to terminate respectively at the mid-way area of said box-like sections; and a closure member slidable on each of said zippers having two pull tabs.

6. The invention as defined in claim 5 wherein:

said central strip is of shorter length than the length of said box-like sections.

* * * * *